US008125428B2

(12) United States Patent
Koo et al.

(10) Patent No.: US 8,125,428 B2
(45) Date of Patent: Feb. 28, 2012

(54) LIQUID CRYSTAL DISPLAY AND DRIVING METHOD THEREOF

(75) Inventors: Sung Jo Koo, Daegu (KR); Su Hyuk Jang, Daegu (KR); Song Jae Lee, Gyeonggi-do (KR); Hong Sung Song, Gyeongsangbuk-do (KR); Woong Ki Min, Daegu (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/026,671

(22) Filed: Feb. 14, 2011

(65) Prior Publication Data

US 2011/0134169 A1 Jun. 9, 2011

Related U.S. Application Data

(62) Division of application No. 12/003,760, filed on Dec. 31, 2007, now Pat. No. 7,961,163.

(30) Foreign Application Priority Data

Jun. 26, 2007 (KR) ..... 10-2007-0063058

(51) Int. Cl.
*G09G 3/36* (2006.01)

(52) U.S. Cl. ..... 345/87; 345/89; 345/98

(58) Field of Classification Search ..... 345/87, 345/89, 98, 100
See application file for complete search history.

(56) References Cited

U.S. PATENT DOCUMENTS

| | | | |
|---|---|---|---|
| 6,335,718 | B1 | 1/2002 | Hong et al. |
| 2005/0128175 | A1 | 6/2005 | Hong |

FOREIGN PATENT DOCUMENTS

| | | |
|---|---|---|
| JP | 2004-220022 | 8/2004 |
| JP | 2005-004202 | 1/2005 |
| JP | 2005-181669 | 7/2005 |
| JP | 2006-113359 | 4/2006 |
| KR | 2000-0046659 | 7/2000 |

*Primary Examiner* — Amare Mengistu
*Assistant Examiner* — Premal Patel
(74) *Attorney, Agent, or Firm* — Morgan, Lewis & Bockius LLP

(57) ABSTRACT

A liquid crystal display device includes a data transition part to compare a number of transitions between a previous data and a current data and to compare a number of transitions between the current data and a next data to determine whether or not the current data is to be inverted in accordance with a comparison result thereof, and to determine whether or not the current data is to be inverted in accordance with a high level number difference of the data, thereby generating a reverse signal when the current data is inverted, a memory to store a data from the data transition part, a data reverse transition part to reversely convert the data from the memory using the reverse signal, a lookup table to compare the current data and the previous frame data reversely converted by the data reverse transition part to select a modulated data and a display drive circuit to display the data from the lookup table on a liquid crystal display panel.

7 Claims, 11 Drawing Sheets

Fig. 11

Data INPUT SEQUENCE

| 16bit DATA | TRANSITION NUMBER |
|---|---|
| 0000000000000000 | |
| 0000000000001111 | 4 |
| 0110011111101111 | 8 |
| 0111000000000000 | 11 |
| 0000000000000000 | 3 |
| 0000000000001111 | 4 |
| 0110011111101111 | 8 |
| 0111000000000000 | 11 |
| TOTAL | 49 |
| | |
| HIGH LEVEL NUMBER | 36 |

DATA TRANSITION

| CONVERTED DATA | TRANSITION NUMBER |
|---|---|
| 0000000000000000 | |
| 0000000000001111 | 4 |
| 1001100000010000 | 8 |
| 0111000000000000 | 5 |
| 0000000000000000 | 3 |
| 0000000000001111 | 4 |
| 1001100000010000 | 8 |
| 0111000000000000 | 5 |
| TOTAL | 37 |
| | |
| HIGH LEVEL NUMBER | 22 |

: DATA INVERSION

LIQUID CRYSTAL DISPLAY AND DRIVING METHOD THEREOF

This application is a divisional application of U.S. patent application Ser. No. 12/003,760 filed Dec. 31, 2007 now U.S. Pat. No. 7,961,163, which claims the benefit of the Korean Patent Application No. P07-063058 filed on Jun. 26, 2007, both of which are hereby incorporated by reference.

BACKGROUND OF THE INVENTION

1. Field of the Invention

The present invention relates to a liquid crystal display and driving method thereof, and more particularly to a liquid crystal display and driving method thereof that is adapted to minimizing heat generation of a circuit and electromagnetic interface (EMI).

2. Discussion of the Related Art

A liquid crystal display device controls the light transmittance of liquid crystal cells in accordance with video signals, thereby displaying a picture. Among liquid crystal display devices, an active matrix type liquid crystal display device, which includes a switch device formed at each liquid crystal cell, is advantageous in displaying a motion picture because the switch device may be actively controlled. A thin film transistor (hereinafter, referred to as "TFT") is mainly used as the switch device used in the active matrix type liquid crystal display device. Equations 1 and 2 show the disadvantages of liquid crystal display devices, such as slow response speeds due to characteristics of liquid crystals, such as viscosity, elasticity, and other properties.

$$\tau_r \propto (\gamma d^2/(\Delta\epsilon|V_a^2-V_F^2|)) \quad \text{(Equation 1)}$$

Herein, "$\tau_r$" represents a rising time when a voltage is applied to a liquid crystal, "$V_a$" represents an applied voltage, "$V_F$" represents a Freederick transition voltage in which liquid crystal molecules start a tilt motion, "d" represents a cell gap of a liquid crystal cell, and "γ" (gamma) represents a rotational viscosity of liquid crystal molecules.

$$\tau_f \propto (\gamma d^2/K) \quad \text{(Equation 2)}$$

Herein, "$\tau_f$" represents a falling time when a liquid crystal is restored back to its original location due to an elasticity restoring force after the voltage applied to the liquid crystal is turned off, and "K" represents a unique elastic constant of liquid crystals.

TN (twisted nematic) mode is currently the most generally used liquid crystal mode in liquid crystal display devices.

Response speed of TN mode liquid crystal may be changed by changing the properties of the liquid crystal material, a cell gap, and other operational parameters. Generally, however, rising time is about 20 ms to about 80 ms and falling time is about 20 ms to about 30 ms. Accordingly, the response speed of the liquid crystal is generally longer than a typical one frame period (NTSC: 16.67 ms) of an image. In other words, as shown in FIG. 1, even before the voltage charged in the liquid crystal cell reaches a desired voltage in one frame period, the image advances to the next frame, thereby creating a motion blurring phenomenon in which a screen in the motion picture becomes blurred.

As shown in FIG. 1, a liquid crystal display device of the related art cannot properly render a desired color and brightness because display brightness BL corresponding thereto does not reach the desired brightness due to the slow response speed of the liquid crystal when data VD is changed from one level to another level. As a result, in the liquid crystal display device, a motion blurring phenomenon in a motion picture is generated and the picture quality thereof decreases due to the reduction of contrast ratio.

In order to solve the slow response speed of the liquid crystal display device, an overdriving method, as shown in FIG. 2, modulates an input data VD to a preset modulated data MVD and applies the modulated data MVD to a liquid crystal cell to obtain a desired brightness MBL. The overdriving method increases $|V_a^2-V_F^2|$ in Equation 1 above based on whether or not the data is changed, so that the desire brightness may be obtained corresponding to a brightness value of the input data within one frame period. Accordingly, the overdriving method compensates the slow response speed of the liquid crystal with the modulation of the data value to mitigate the motion blurring phenomenon in the motion picture.

FIG. 3 illustrates an overdriving circuit according to a related art. As shown in FIG. 3, the overdriving circuit includes a frame memory 33 for storing data from a data bus 32 and a lookup table for modulating the data. The frame memory 33 stores the data and supplies the stored data as a previous frame data Fn−1 to the lookup table 34. The lookup table 34 takes current frame data Fn and the previous frame data Fn−1 from the frame memory 33 as an address to select a preset modulated data MRGB, thereby modulating the data. The lookup table 34 includes a read only memory (ROM) and a memory address control circuit. Table 1 illustrates an example of the lookup table 34.

TABLE 1

| Classification | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In TABLE 1 shown above, the leftmost column represents data of the previous frame Fn−1, and an uppermost row represents data of the current frame Fn. The overdriving circuit, as shown in FIG. 3, needs the frame memory 33 for storing the previous frame data. The frame memory 33 included in a liquid crystal display device is a major cause of increased circuit cost.

Further, the lookup table 34 may be embedded in a timing controller for controlling drive circuits of a liquid crystal display panel. In such a case, other problems exist, such as increased electromagnetic interference (EMI) in a data transmission path between the timing controller and the frame memory 33 and increased heat generation of the timing controller. In addition, size of the chip of the timing controller becomes large. This is because there is a large amount of data transition transmitted between the frame memory 33 and the lookup table 34 loaded within the timing controller.

SUMMARY OF THE INVENTION

Accordingly, the present invention is directed to a liquid crystal display and a driving method thereof that substantially obviates one or more problems due to limitations and disadvantages of the related art.

An object of the present invention is to provide a liquid crystal display device and a driving method thereof that is adapted to minimizing heat generation of a circuit and EMI by reducing data transitions between a lookup table and a memory in a circuit that modulates digital video data to improve response characteristics of liquid crystal.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a data transition part to compare a number of transitions between a previous data and a current data and to compare a number of transitions between the current data and a next data to determine whether or not the current data is to be inverted in accordance with a comparison result thereof, and to determine whether or not the current data is to be inverted in accordance with a high level number difference of the data, thereby generating a reverse signal when the current data is inverted, a memory to store a data from the data transition part, a data reverse transition part to reversely convert the data from the memory using the reverse signal, a lookup table to compare the current data and the previous frame data reversely converted by the data reverse transition part to select a modulated data and a display drive circuit to display the data from the lookup table on a liquid crystal display panel.

In another aspect, a method of driving a liquid crystal display device, includes comparing a number of transitions between a previous data and a current data and comparing a number of transitions between the current data and a next data to determine whether or not the current data is to be inverted in accordance with a comparison result thereof, and determining whether or not the current data is to be inverted in accordance with a high level number difference of the data, thereby supplying the inverted data to a memory and generating a reverse signal when the current data is inverted, reversely converting the data from the memory using the reverse signal, comparing the current data and the reversely-converted data to select a modulated data, and displaying the data from the lookup table on a liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 11 is a diagram illustrating an example of converting data as shown in FIG. 9 by the data transition part as shown in FIG. 10.

DETAILED DESCRIPTION OF THE EMBODIMENTS

Reference will now be made in detail to the embodiments of the present invention, examples of which are illustrated in the accompanying drawings.

Figure 1:
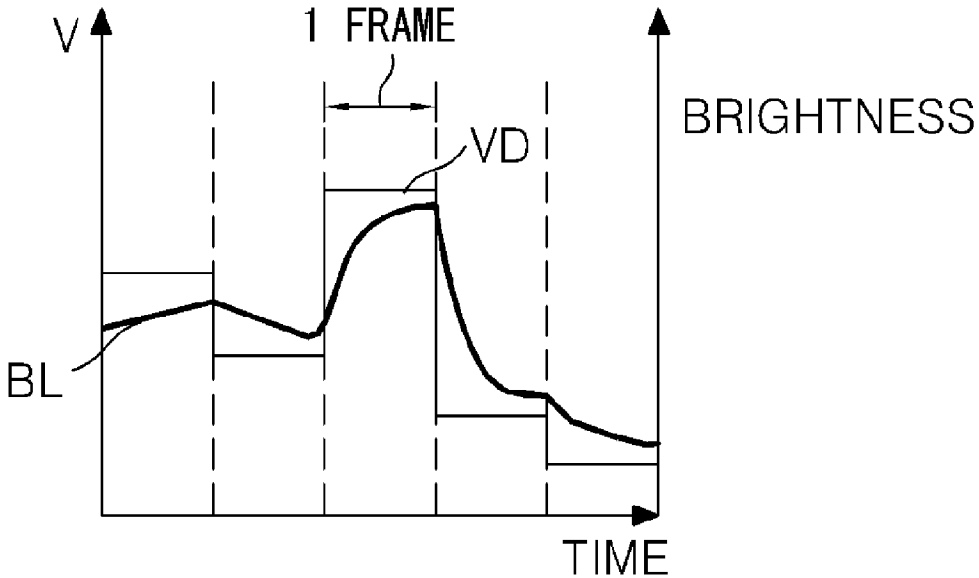
Fig. 1 [RELATED ART]
FIG. 1 is a waveform diagram illustrating a brightness change in accordance with a data in a liquid crystal display device of the related art.
Figure 2:
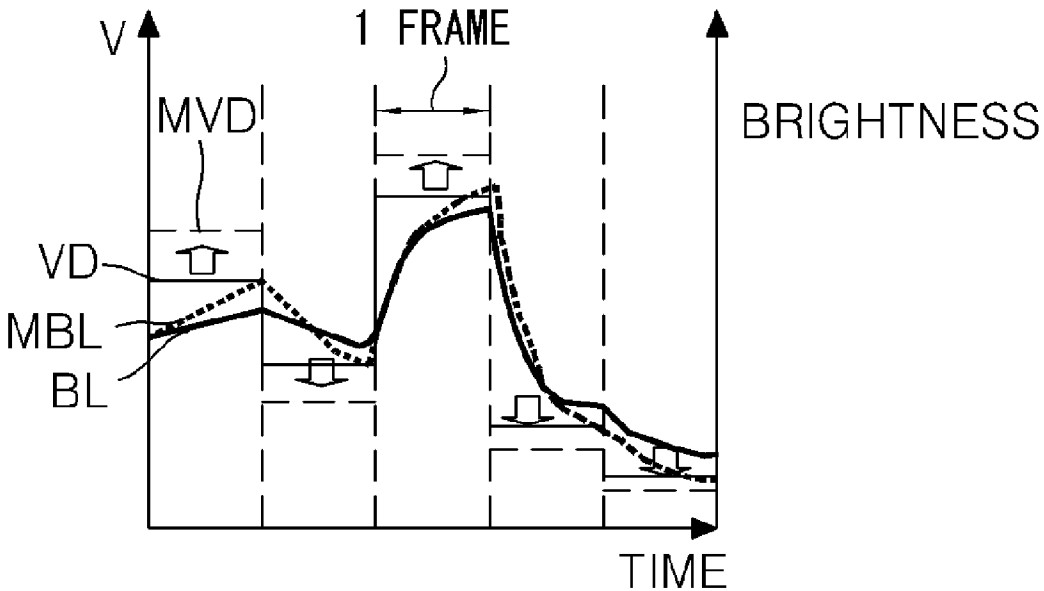
Fig. 2 [RELATED ART]
FIG. 2 is a waveform diagram illustrating an improvement effect of a liquid crystal response characteristic caused by overdriving.
Figure 3:
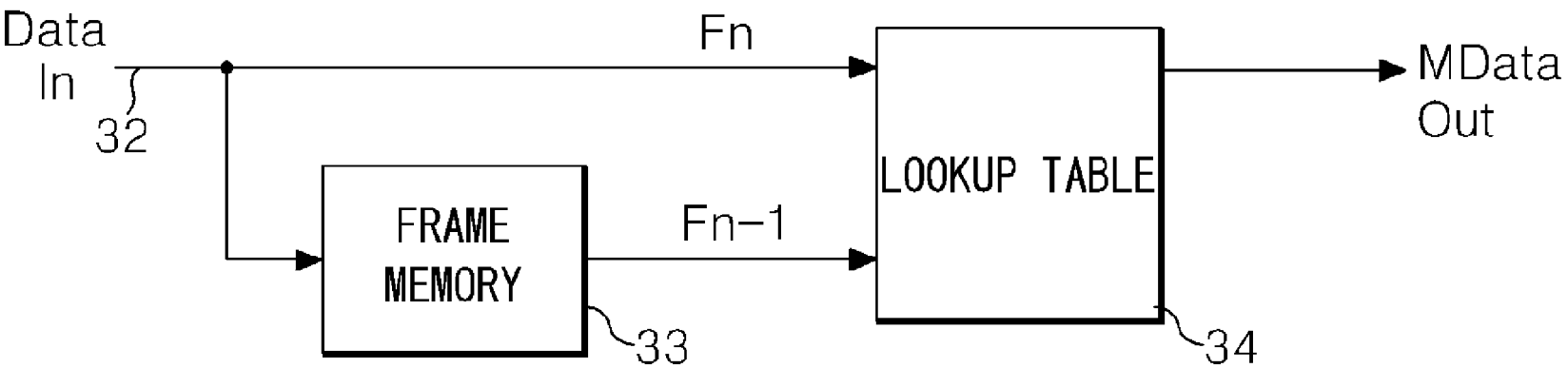
Fig. 3 [RELATED ART]
FIG. 3 is a circuit diagram illustrating an example of an overdriving circuit.
Figure 4:
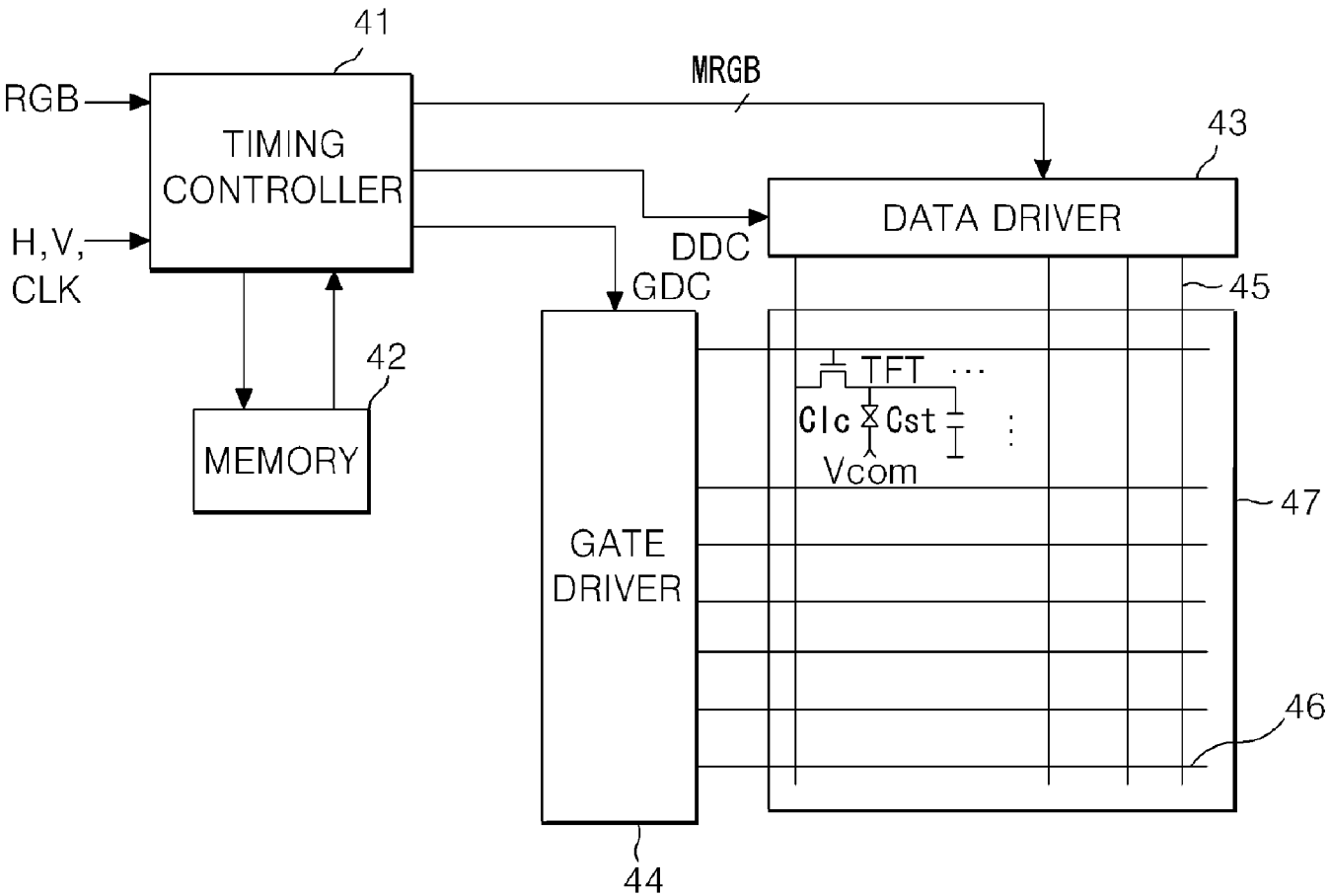
FIG. 4 is a block diagram illustrating a liquid crystal display device according to an exemplary embodiment the present invention.

As shown in FIG. 4, a liquid crystal display device according to an exemplary embodiment of the present invention includes a liquid crystal display panel 47 having data lines 45 crossing gate lines 46 and thin film transistors ("TFTs") for driving liquid crystal cells Clc formed at the crossing parts thereof. A data driver 43 supplies data to the data lines 45 of the liquid crystal display panel 47, and a gate driver 44 supplies scan pulses to the gate lines 46 of the liquid crystal display panel 47. A timing controller 41 controls the data driver 43 and the gate driver 44 and supplies source data RGB to a memory 42 connected to the timing controller 41.

In the liquid crystal display panel 47, liquid crystal is injected between two glass substrates. On one glass substrate, data lines 45 and gate lines 46 are formed to perpendicularly cross each other. TFTs are formed at the crossing parts of the data lines 45 and the gate lines 46 to supply the data from the data lines 45 to the liquid crystal cells Clc. To this end, a gate electrode of the TFT is connected to the gate line 46 and a source electrode thereof is connected to the data line 45. A drain electrode of the TFT is connected to a pixel electrode of the liquid crystal cell Clc. Storage capacitors are formed for maintaining the voltage of the liquid crystal cells Clc. The storage capacitor Cst may be formed between the liquid crystal cell Clc and pre-stage gate line 46 or may be formed between the liquid crystal cell Clc and a separate common line.

The timing controller 41 generates a gate control signal GDC for controlling an operation timing of the gate driver 44 using vertical/horizontal synchronization signals V, H, and a clock CLK, a data control signal DDC for controlling an operation timing of the data driver 43, and a control signal for controlling the memory 42. The timing controller 41 samples digital video data RGB in accordance with the clock CLK, compresses the data RGB, converts the data to reduce the number of data transitions, stores the converted data in the memory 42, and reads the previous frame data from the memory 42. Further, in the timing controller 41, there is embedded a lookup table that stores the modulated data for modulating a response speed of a liquid crystal. The timing controller 41 supplies the previous frame data read from the memory 42 to the lookup table after converting the previous frame data reversely by the data transition and restoring the compressed data. The lookup table compares the current frame data and the previous frame data and selects the modulated data that satisfies conditions as further described below. The timing controller 41 supplies the modulated data MRGB selected by the lookup table to the data driver 43.

In the exemplary embodiment of the present invention, the modulated data stored in the lookup table satisfies the conditions of Equations 3 to 5 as follows.

$$Fn(RGB)>Fn-1(RGB)->Fn(MRGB)>Fn(RGB) \quad \text{(Equation 3)}$$

$$Fn(RGB)<Fn-1(RGB)->Fn(MRGB)<Fn(RGB) \quad \text{(Equation 4)}$$

$$Fn(RGB)=Fn-1(RGB)->Fn(MRGB)=Fn(RGB) \quad \text{(Equation 5)}$$

Based on Equations 3 to 5, the modulated data MRGB has a higher value than the data of the current frame Fn if a pixel data value becomes higher in the same pixel in the current frame Fn than in the previous frame Fn−1. The modulated data MRGB has a lower value than the data of the current frame Fn if the pixel data value becomes lower in the same pixel in the current frame Fn than in the previous frame Fn−1. The modulated data MRGB is set to be the same value as the data of the current frame Fn if the pixel data value is the same in the pervious frame Fn−1 and the current frame Fn. Herein, an average value of the previous frame is substituted for the data of the previous frame Fn−1, as described further below.

The memory 41 outputs the data from the timing controller 41 after storing the data for one frame period, thereby supplying the previous frame data, which is to be supplied to the lookup table, to the timing controller 41. The timing controller 41 and the memory 42 transmit a data of 15 bits, for example, and a reverse signal REV of 1 bit, for example, when a resolution of the liquid crystal display panel 47 is 1366×768. However, different number of bits depending on the size of the liquid crystal display panel 47 may be used without departing from the scope of the present invention. Moreover, the memory 42 may be any memory, but a synchronous dynamic random access memory (SDRAM) is advantageous due to cost and performance.

The data driver 43 includes a shift register, a register for temporarily storing the modulated data MRGB from the timing controller 41, a latch for simultaneously outputting the data of one line portion after storing the modulated data MRGB in response to the clock signal from the shift register, a digital/analog converter for converting the modulated data MRGB from the latch into an analog positive/negative gamma compensation voltage, a multiplexer for selecting the positive/negative gamma compensation voltage, and an output buffer connected between the multiplexer and the data line. The data driver 43 receives the modulated data MRGB and supplies the modulated data MRGB to the data lines 45 of the liquid crystal display panel 47 under control of the timing controller 41.

The gate driver 44 includes a shift register for sequentially generating scan pulses in response to the gate control signal GDC from the timing controller 41, a level shifter for shifting a swing width of the scan pulse to a level suitable for driving the liquid crystal cell Clc, and an output buffer. The gate driver 44 supplies the scan pulse to the gate line 46 to turn on the TFT connected to the gate line 46, thereby selecting the liquid crystal cells Clc of one horizontal line to be supplied with a pixel voltage of the data, i.e., the analog gamma compensation voltage. The data generated from the data driver 43 are synchronized with the scan pulses to be supplied to the liquid crystal cells Clc of the selected one horizontal line.

Figure 5:
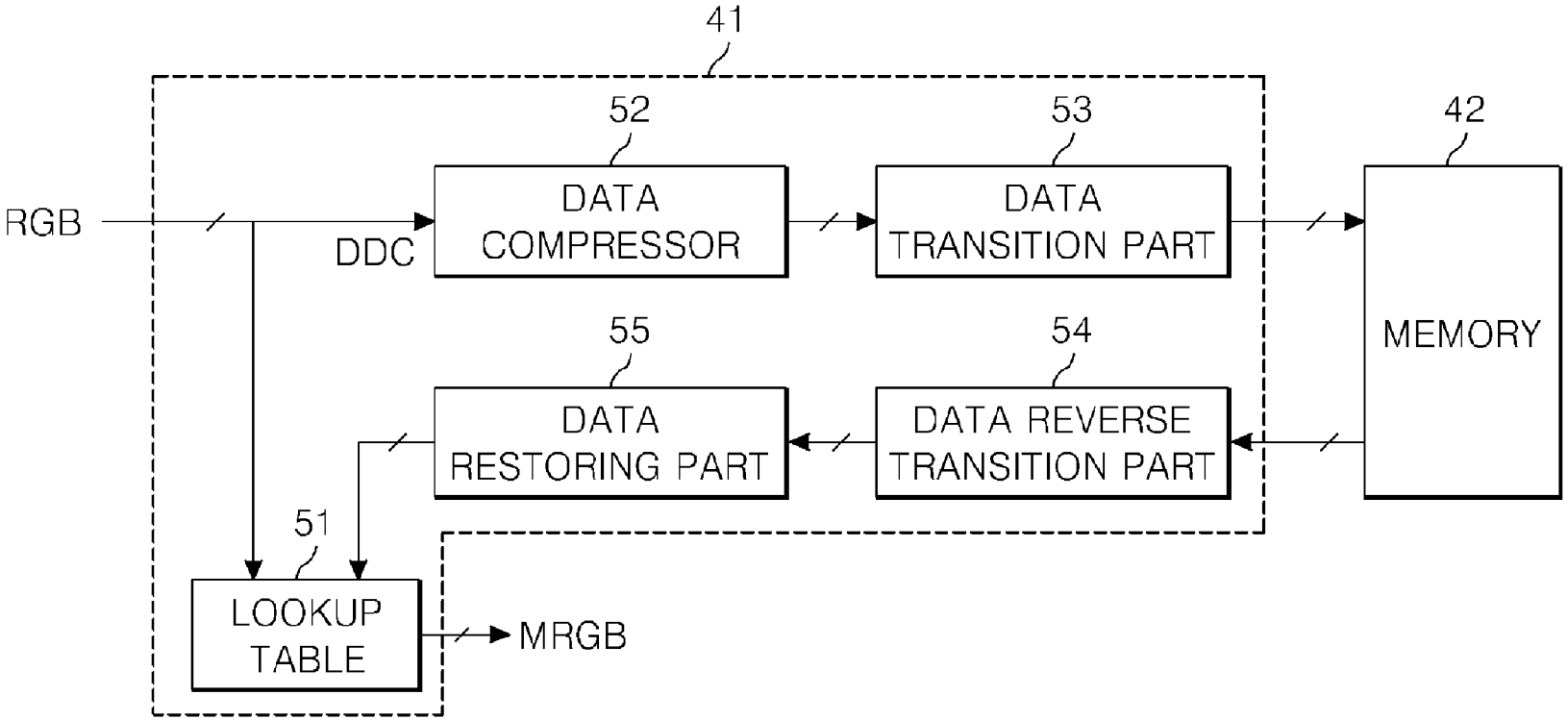
FIG. 5 is a circuit diagram illustrating an exemplary data modulator of a timing controller shown in FIG. 4.

FIG. 5 is a circuit diagram illustrating an exemplary data modulator of the timing controller 41. As shown in FIG. 5, the exemplary modulator of the timing controller 41 according to the present invention includes a data compressor 52, a data transition part 53, a data reverse transition part 54, a data restoring part 55, and a lookup table 51. The data compressor 52 compresses the source data RGB using a pre-determined compression algorithm. The compression algorithm may be any known compression algorithm, and it is possible to select a compression method and device disclosed in co-pending Korean patent application Nos. P2003-98100, P2004-49541, P2004-115730, P2004-116342, P2004-116347, and P2006-116974. The data compressor 52 compresses the data at a ratio of 3.2:1, for example, if the data of 15 bits is transmitted between the timing controller 41 and the memory 42, and supplies the compressed data to the memory 42.

The data transition part 53 converts the data by the following two methods and generates a reverse signal REV to reduce the number of transitions of the data transmitted between the timing controller 41 and the memory 42. Reducing the number of data transitions reduces EMI between the timing controller 41 and the memory 42 and reduces a heat generation amount of the memory 42 and the timing controller 41.

The data reverse transition part 54 reversely converts the data using the reverse signal REV. The data restoring part 55 restores the compressed data by a restoration algorithm corresponding to the compression algorithm and supplies the restored data to the lookup table 51. The lookup table 51 stores the modulated data described above.

Figure 6:
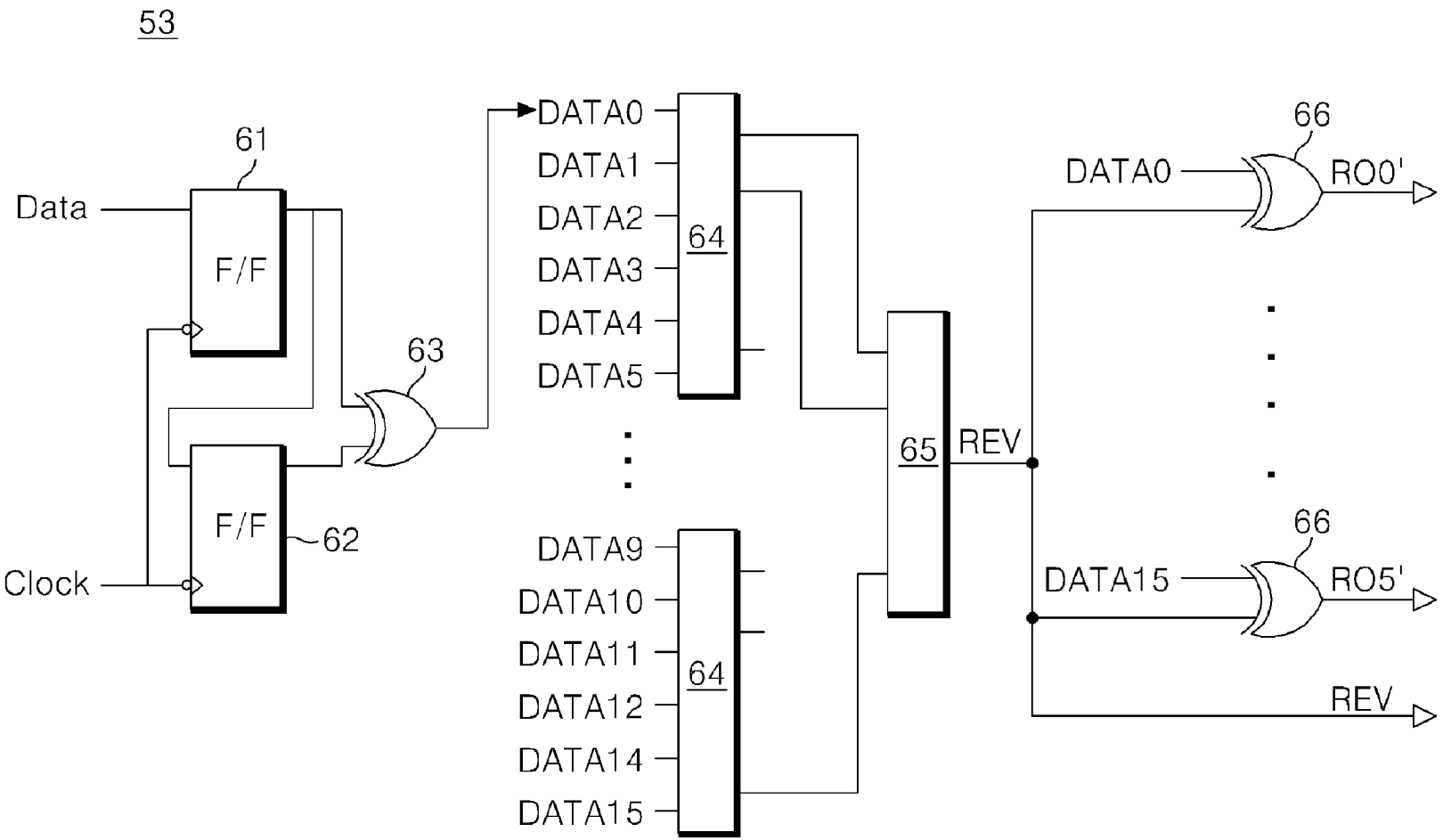
FIG. 6 is a circuit diagram illustrating an exemplary data transition part according to a first embodiment of the present invention.
Figure 7:
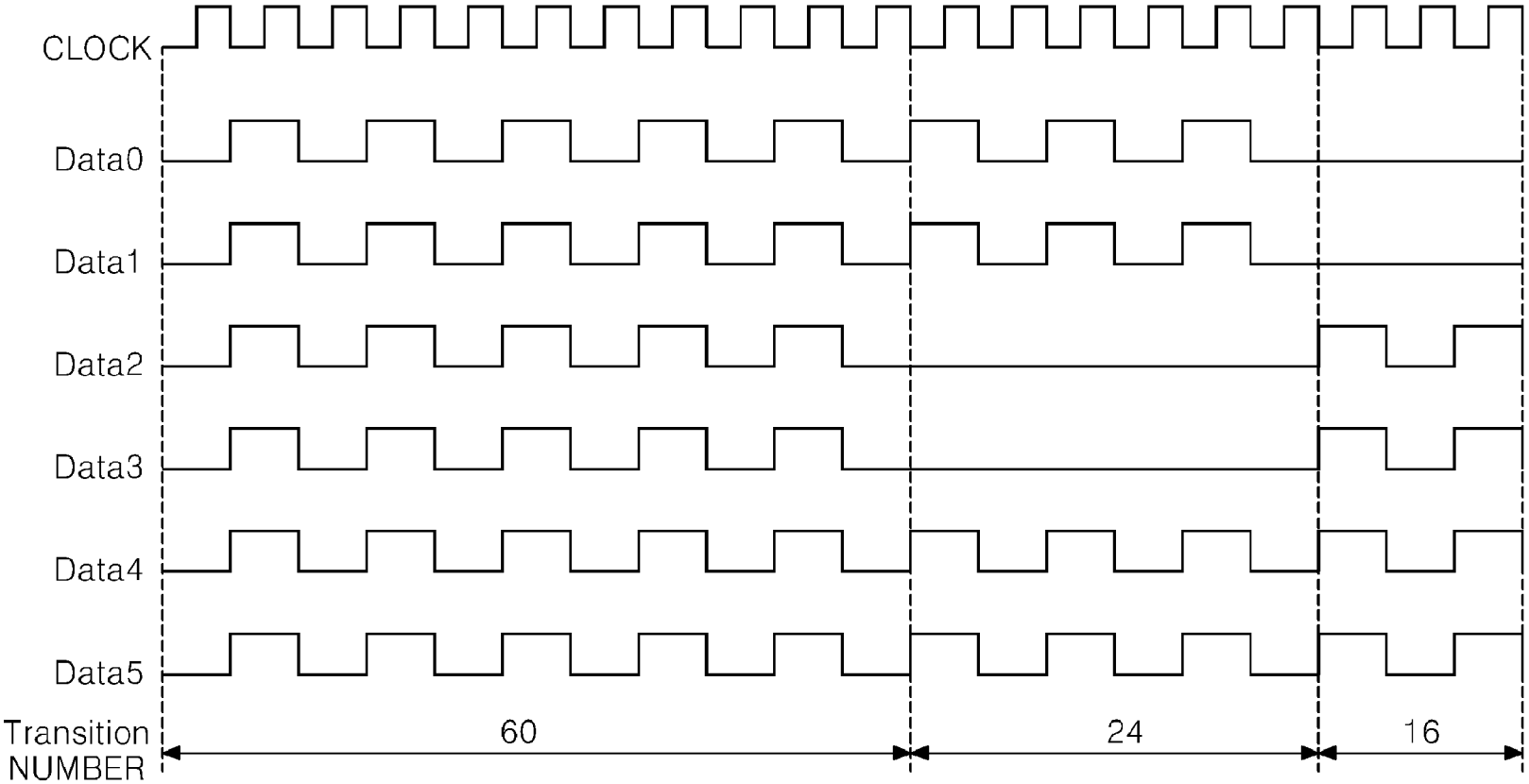
FIG. 7 is a waveform diagram illustrating an example of data directly input to a memory without a transition process.
Figure 8:
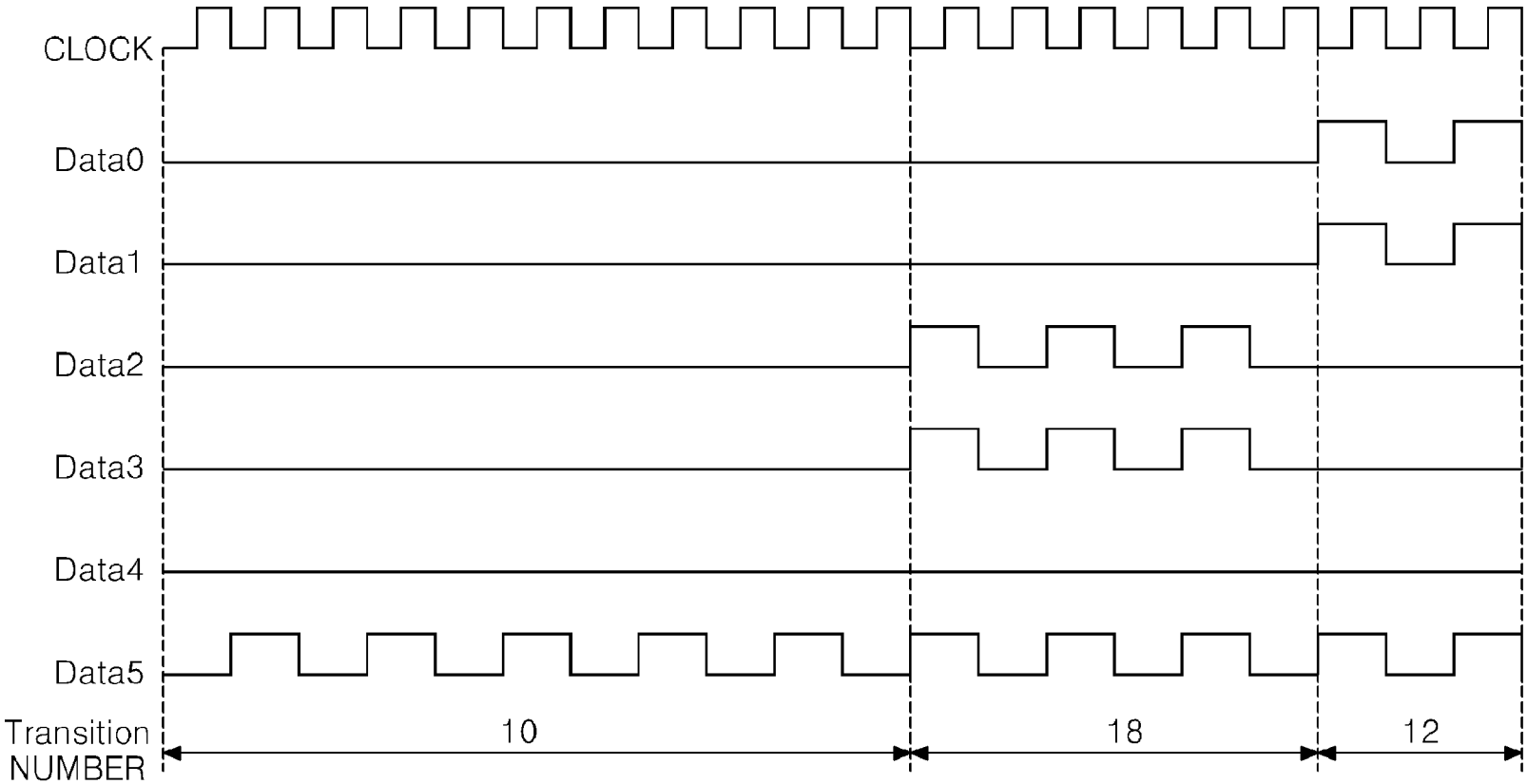
FIG. 8 is a waveform diagram illustrating an example of a reverse signal and the data having gone through the transition process.

FIG. 6 is a circuit diagram illustrating a first exemplary embodiment of the data transition part 53. As shown in FIG. 6, the data transition part 53 compares the previous bit of the data and the current bit thereof using an XOR gate 63. The XOR gate 63 outputs a high level of "1" when the previous bit is different from the current bit and outputs a low level of "0" in other cases, thereby detecting a change between the previous bit and the current bit. The outputs of the XOR gate 63, which respectively compare the 15 bits of the data, are added by an adder 64. A reverse signal output part 65 analyzes the output of the adder 64 and outputs the reverse signal REV to have the high level of "1" if the number of high levels is greater than or equal to a predetermined threshold value (i.e., if the transitions generated are greater than or equal to the threshold value bits, for example 8 bits among the 15 bits of the input data when being compared with the previous data). The predetermined threshold value may be changed by user data. The reverse signal REV output from the reverse signal output part 65 is input to an output side XOR gate 66. The output side XOR gate 66 performs an exclusive OR operation on the reverse signal REV and each bit of the input data and inverts each bit of the input data if the reverse signal REV is at the high level. FIG. 7 illustrates an example of directly inputting the data to the memory 42 without a transition process. FIG. 8 illustrates an example of inputting the reverse signal REV and the data, which went through a transition process, to the memory 42. As shown in FIGS. 7 and 8, if there are many transitions of the input data in the data transition process, almost no data transition is made due to the inversion of the data, and the reverse data REV indicates an inversion point of time of the data.

Figure 9:
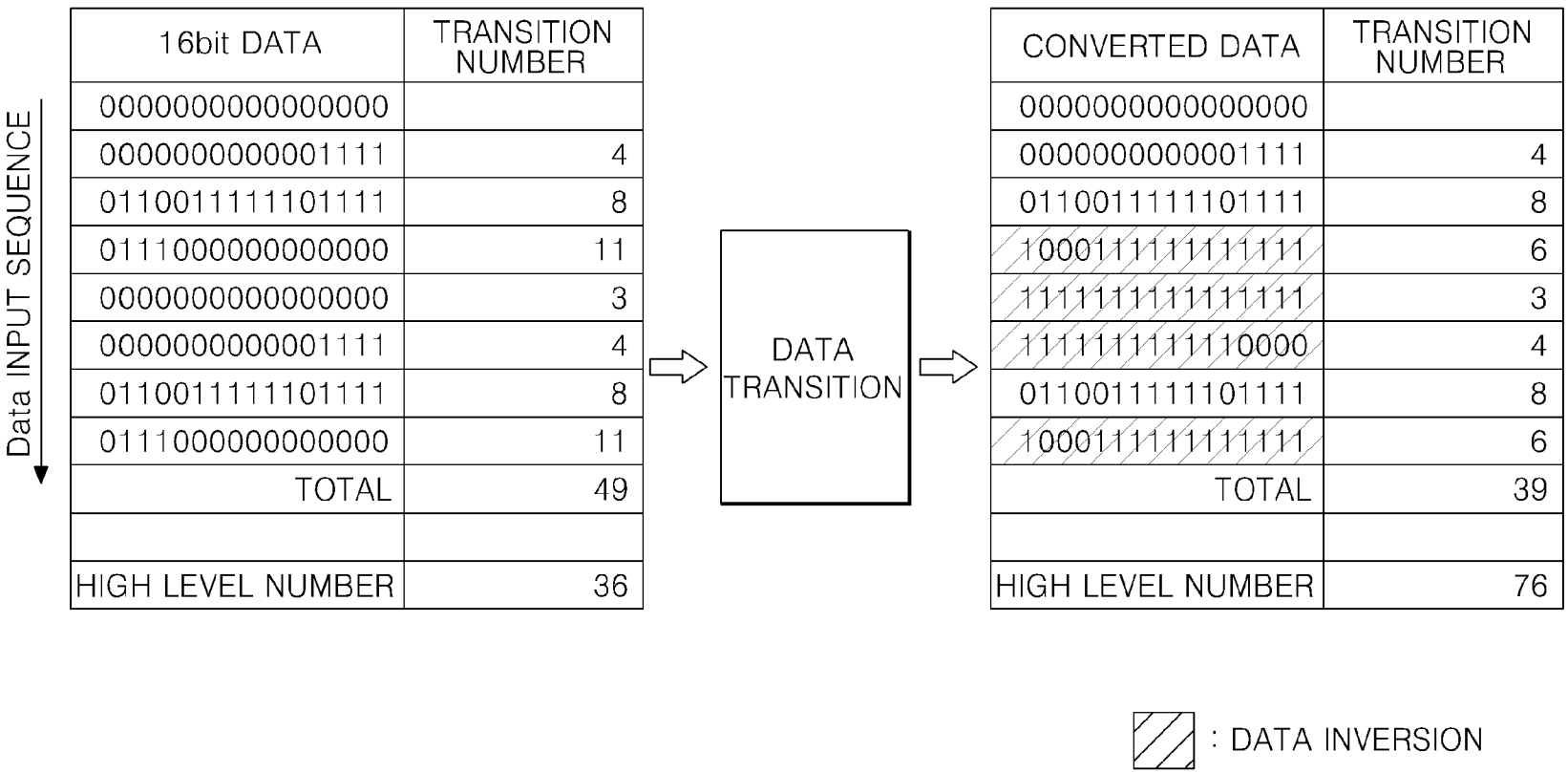
FIG. 9 is a diagram illustrating a change in the number of transitions before/after the data transition between a timing controller and a memory.

FIG. 9 illustrates a change of the number of transitions before/after the data transition based on data of 16 bits transmitted between the timing controller 41 and the memory 42. As shown in the left table of FIG. 9, if the 16 bit data before the data transition is input in the order: "0000000000000000"->"0000000000001111"(4)-> "0110011111101111"(8)->"0111000000000000"(11)-> "0000000000000000"(3)->"0000000000001111"(4)\-> "0110011111101111"(8)->"0111000000000000"(11), the number of data transitions equals to the number in parentheses "( )" In comparison with this, if the data is inverted when the number of transitions between the previous data and the current data exceeds 8, it is changed to: "0000000000000000"->"0000000000001111"(4)-> "0110011111101111"(8)->"1000111111111111"(6)-> "1111111111111111"(3)->"1111111111110000"(4)-> "0110011111101111"(8)->"1000111111111111"(6) like a right table of FIG. 9, thus the number of transitions is reduced like the number in the parentheses "( )".

The first exemplary embodiment described above compares the current data and the previous data and inverts the data when the number of transitions exceeds a preset reference value as the comparison result, thereby reducing the number of transitions. In comparison with this, a following second exemplary embodiment of the present invention may further reduce the number of transitions if the current data is compared with the previous data and is also compared with the next data to determine whether or not the data is to be converted.

Figure 10:
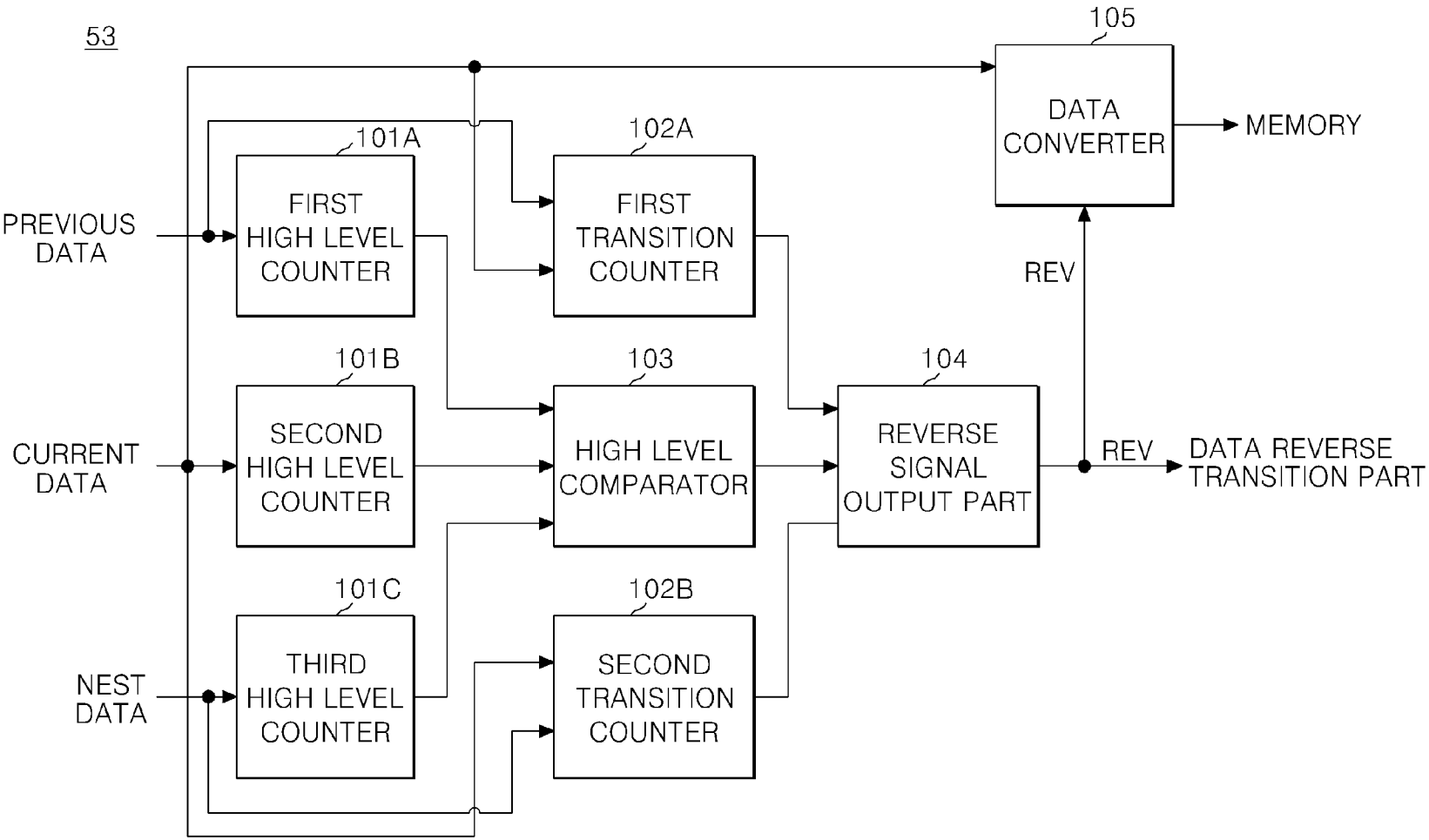
FIG. 10 is a circuit diagram illustrating an exemplary data transition part according to a second embodiment of the present invention.

FIG. 10 is a circuit diagram illustrating a second exemplary embodiment of the data transition part 53. As shown in FIG. 10, the data transition part 53 includes a first high level counter 101A, a second high level counter 101B, a third high level counter 101C, a first transition counter 102A, a second transition counter 102B, a high count comparator 103, a reverse signal output part 104, and a data converter 105.

The first high level counter 101A counts the high levels in the previous data of 16 bits, for example, to supply a count value to the high count comparator 103. The second high level counter 101B counts the high levels in the current data of 16 bits, for example, to supply the count value to the high count comparator 103. The third high level counter 101C counts the high levels in the next data of 16 bits, for example, to supply the count value to the high count comparator 103.

The first transition counter 102A counts the number of transitions between the previous data of 16 bits and the current data of 16 bits and supplies the output of the high level to the reverse signal output part 104 when the transition count value exceeds a designated first reference value, such as "8" for example. On the other hand, the first transition counter 102A supplies the output of the low level to the reverse signal output part 104 when the transition count value is not greater than the first reference value. The second transition counter 102B counts the number of transitions between the current data of 16 bits and the next data of 16 bits and supplies the output of the high level to the reverse signal output part 104 when the transition count value exceeds a designated second reference value, such as "8" for example. On the other hand, the second transition counter 102B supplies the output of the low level to the reverse signal output part 104 when the transition count value is not greater than the second reference value.

The high count comparator 103 analyzes the number of high levels between the previous data and the next data and between the current data and the previous data. The high count comparator 103 supplies the output of the high level to the reverse signal output part 104 if a high level difference between the previous data and the next data is equal to or less than a third reference value, such as "2" for example, and if a high level number difference between the current data and the previous data is greater than a fourth reference value, such as "7" for example. On the other hand, the high count comparator 103 supplies the output of the low level to the reverse signal output part 104 if the high level difference between the previous data and the next data is greater than the third reference value, or if the high level number difference between the current data and the previous data is not greater than the fourth reference value.

The reverse signal output part 104 outputs the reverse signal REV at the high level when the output of the first transition counter 102A is at the high level, i.e., when the number of transitions between the previous data and the current data is greater than the first reference value. Further, the reverse signal output part 104 outputs the reverse signal REV at the high level under a following condition when the output of the first transition counter 102A is at the low level, i.e., when the number of transitions between the previous data and the current data is not greater than the first reference value.

When the output of the first transition counter 102A is at the low level, the reverse signal output part 104 outputs the reverse signal REV at the high level if the output of the high count comparator 103 is at the high level and the output of the second transition counter 102B is at the high level. In other words, the inversion signal output part 104 outputs the reverse signal REV at the high level if the high level difference between the previous data and the next data is equal to or less than the third reference value and if the high level number difference between the current data and the previous data is greater than the fourth reference value even though the number of transitions between the previous data and the current data is not greater than the first reference value. In all other cases, the reverse signal output part 104 generates the output of the low level. The above reference values may be changed in accordance with a drive characteristic or an operation mode of the liquid crystal display panel without departing from the scope of the present invention.

The data converter 105 performs the exclusive OR operation on each bit of the input data and the reverse signal REV using the XOR gate 66, as shown in FIG. 6, thereby inverting each bit of the input data when the output of the reverse signal REV is at the high level. The data reverse transition part 54 reversely converts the data by the exclusive OR operation using the reverse signal REV.

FIG. 11 illustrates an example of converting data by the data transition part 53, as shown in FIG. 10, using data of 16 bits, for example, as shown in FIG. 9. As shown in FIG. 11, the data transition part 53 according to the second exemplary embodiment of the present invention optimizes a data inversion condition of the current data in consideration of all of the previous data and the next data, thereby further reducing the number of transitions of the data transmitted between the timing controller 41 and the memory 42. The data are inverted in shaded-parts of FIGS. 9 and 11. As shown in FIG. 11, the third and seventh data among the first to eighth data are inverted because they satisfy the condition that the high level difference between the previous data and the next data is equal to or less than the third reference value and the high level number difference between the current data and the previous data is greater than the fourth reference value among the above-mentioned inversion conditions.

As described above, the liquid crystal display device and the driving method thereof according to the exemplary embodiments of the present invention selectively inverts the data if the number of transitions between the previous data and the current data is high after comparing the previous data and the current data, or in accordance with a comparison result after comparing the reference value with the high level number and the transition number between the previous data and the current data and between the next data and the current data. As a result thereof, the liquid crystal display device and the driving method thereof according to the embodiment of the present invention may minimize the heat generation of the circuit and the EMI by reducing the data transitions between the timing controller and the memory in the circuit which modulates the digital video data for improving the response characteristic of the liquid crystal.

It will be apparent to those skilled in the art that various modifications and variations can be made in the liquid crystal display and the driving method thereof of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a data transition part to compare a number of transitions between a previous data and a current data and to compare a number of transitions between the current data and a next data to determine whether or not the current data is to be inverted in accordance with a comparison result thereof, and to determine whether or not the current data is to be inverted in accordance with a high level number difference of the data, thereby generating a reverse signal when the current data is inverted;

a memory to store a data from the data transition part;

a data reverse transition part to reversely convert the data from the memory using the reverse signal;

a lookup table to compare the current data and the previous frame data reversely converted by the data reverse transition part to select a modulated data; and a display drive circuit to display the data from the lookup table on a liquid crystal display panel.

2. The liquid crystal display device according to claim 1, further comprising:

a data compressor to compress the data to supply the compressed data to the data transition part; and a data restoring part to restore the data from the data reverse transition part using a restoration algorithm corresponding to a compression algorithm of the data compressor and to supply the restored data to the lookup table.

3. The liquid crystal display device according to claim 2, further comprising a timing controller including the data transition part, the data reverse transition part, the lookup table, the data compressor, and the data restoring part to control an operation timing of the display drive circuit.

4. The liquid crystal display device according to claim 1, wherein the data transition part includes a first high level counter to count a number of high levels in the previous data, a second high level counter to count a number of high levels in the current data, a third high level counter to count a number of high levels in the next data, a first transition counter to count the number of transitions between the previous data and the current data to generate an output of the high level if a transition count value is greater than a first reference value, a second transition counter to count the number of transitions between the current data and the next data to generate the output of the high level if the transition count value is greater than a second reference value, a high count comparator to generate an output of a high level if a high level difference between the previous data and the next data is not greater than a third reference value, and if a high level difference between the current data and the previous data is greater than a fourth reference value, a reverse signal output part to generate the reverse signal if an output of the first transition counter is at the high level, and if both of an output of the high count comparator and an output of the second transition counter are at the high level, and a data converter for inverting the current data in accordance with the reverse signal.

5. A method of driving a liquid crystal display device, comprising the steps of:

comparing a number of transitions between a previous data and a current data and comparing a number of transitions between the current data and a next data to determine whether or not the current data is to be inverted in accordance with a comparison result thereof, and determining whether or not the current data is to be inverted in accordance with a high level number difference of the data, thereby supplying the inverted data to a memory and generating a reverse signal when the current data is inverted;

reversely converting the data from the memory using the reverse signal;

comparing the current data and the reversely-converted data to select a modulated data; and displaying the data from the lookup table on a liquid crystal display panel.

6. The method according to claim 5, further comprising the steps of:

compressing the data before the data is inverted; and restoring the reversely-converted data using a restoration algorithm corresponding to a compression algorithm of the data.

7. The method according to claim 5, wherein supplying the inverted data to the memory and generating the reverse signal includes the steps of counting a number of high levels in the previous data, counting a number of high levels in the current data, counting a number of high levels in the next data, counting a number of transitions between the previous data and the current data to generate an output of the high level when a transition count value is greater than a first reference value, counting a number of transitions between the current data and the next data to generate the output of the high level when the transition count value is greater than a second reference value, generating an output of a high level if a high level difference between the previous data and the next data is not greater than a third reference value and if a high level difference between the current data and the previous data is greater than a fourth reference value, counting the number of transitions between the previous data and the current data to generate the reverse signal if the transition count value is greater than the first reference value, and generating the reverse signal when the high level difference between the previous data and the next data is not greater than the third reference value and a high level number difference between the current data and the previous data is greater than the fourth reference value and when the number of transitions between the current data and the next data is counted and the transition count value is greater than the second reference value, and inverting the current data in accordance with the reverse signal.

* * * * *